US005619850A

United States Patent [19]

Palmer et al.

[11] Patent Number: 5,619,850

[45] Date of Patent: Apr. 15, 1997

[54] GAS TURBINE ENGINE WITH BLEED AIR BUFFER SEAL

[75] Inventors: Donald L. Palmer, Cave Creek; Gulshan K. Arora, Chandler, both of Ariz.

[73] Assignee: AlliedSignal Inc., Morris Township, N.J.

[21] Appl. No.: 438,145

[22] Filed: May 9, 1995

[51] Int. Cl.[6] ..... F02C 7/18

[52] U.S. Cl. ..... 60/39.02; 60/39.07; 60/39.83

[58] Field of Search ..... 60/39.02, 39.07, 60/39.161, 39.83, 39.75; 415/199.6

[56] References Cited

U.S. PATENT DOCUMENTS 2,648,493 8/1953 Stalker .
3,133,693 5/1964 Holl .
3,581,504 6/1971 Andrus .
4,653,267 3/1987 Brodell et al. ..... 60/39.83
4,709,545 12/1987 Stevens et al. ..... 60/39.83
4,815,272 3/1989 Laurello et al. ..... 60/39.83
5,235,803 8/1993 Rodgers .
5,485,717 1/1996 Williams ..... 60/39.161

*Primary Examiner*—Louis J. Casaregola
*Attorney, Agent, or Firm*—James W. McFarland

[57] ABSTRACT

A bleed air buffer seal arrangement is provided for improved buffer sealing of oil sump seals in a gas turbine engine. In a multiple spool gas turbine engine, bleed air for buffer sealing is obtained through an annular bleed slot or annular array of bleed ports formed in the impeller shroud of a high pressure centrifugal impeller at a location spaced aft or downstream from the leading edge thereof. Bleed air from this location exhibits significant pressure at low engine power conditions to provide satisfactory buffer sealing, without subjecting sump seals to excess pressure or temperature at high engine power conditions.

9 Claims, 2 Drawing Sheets

GAS TURBINE ENGINE WITH BLEED AIR BUFFER SEAL

BACKGROUND OF THE INVENTION

This invention relates generally to improvements in gas turbine engines of the type which utilize compressor bleed air to provide air buffer sealing of oil sump seals. More specifically, this invention relates to a bleed air seal arrangement which provides improved buffer sealing at low engine power conditions.

Multiple spool gas turbine engines are generally known in the art, wherein at least two turbocompressor rotating groups are provided in association with a combustor. Each turbocompressor rotating group comprises a compressor stage and a turbine stage mounted on a common spool or shaft, with the shafts of separate rotating groups being arranged in concentric relation to each other. In a typical twin spool engine, a high pressure spool includes a compressor stage and a turbine stage disposed on opposite sides of the engine combustor, and rotatably interconnected by a hollow shaft which rotatably receives the shaft of a low pressure spool including a compressor stage and a turbine stage. In operation, the compressor stages of the low and high pressure spools provide dual stage compression of air which is supplied to the combustor for combustion with a suitable fuel. The hot gases of combustion are then expanded in series through the turbine stages of the high and low pressure spools, respectively, to provide an engine power output. One advantage of multiple spool gas turbine engines of this general type is that such engines can accelerate rapidly in order to accommodate increased power output requirements.

Gas turbine engines of the multiple spool type include a significant number of rotating and related bearing components which require lubrication for continued engine operation. In this regard, oil lubrication systems are well-known for delivering lubricant to selected bearings and related structures throughout the engine. Sump seals having a labyrinth or similar configuration are normally provided to prevent leakage of lubricating oil into the main flow path of air and combustion gases through the engine. Buffer seal arrangements have been proposed to pressurize engine sump seals in order to decrease the likelihood of oil leakage.

More specifically, in a typical buffer seal arrangement in a multiple spool gas turbine engine, a small portion of the compressed air produced by the compressor stage of the low pressure spool is diverted or bled into a buffer chamber within the engine. This bleed-off portion of the compressed air is commonly referred to as bleed air and is ducted from the buffer chamber to appropriate locations adjacent sump seals to provide a pneumatic pressure barrier intended to prevent undesired oil leakage. However, during some engine operating conditions, particularly such as relatively low power and/or transient operating conditions, the pressure of the bleed air can be insufficient to assure that no oil leakage past the sump seals will occur. Indeed, during rapid engine acceleration, the correspondingly rapid acceleration of the high pressure spool can result in a relatively low bleed air pressure between the twin compressor stages, with the undesirable result that sump seal oil leakage can occur.

There exists, therefore, a need for further improvements in bleed air buffer seal arrangements for use in gas turbine engines of the multiple spool type, to positively prevent sump seal oil leakage throughout the range of normal engine operating conditions. The present invention fulfills this need and provides further related advantages.

SUMMARY OF THE INVENTION

In accordance with the invention, a multiple spool gas turbine engine is provided with an improved bleed air buffered seal, or buffer seal, arrangement to prevent oil leakage past oil sump seals located throughout the engine. The improved buffer seal arrangement takes compressor bleed air at elevated pressure from a point spaced aft or downstream from the leading edge of a second or high pressure compressor stage. Bleed air taken from this location exhibits sufficient pressure at low engine power and at transient power conditions to provide improved buffer sealing of oil sump seals.

The multiple spool gas turbine engine comprises a high pressure spool having a compressor stage and a turbine stage mounted on a common shaft and disposed at opposite sides of an engine combustor. A low pressure spool is also provided and includes a compressor stage and turbine stage mounted on a common shaft and disposed respectively at opposite ends of the high pressure spool. The rotatable shaft of the high pressure spool is hollow and is mounted concentrically and rotatably about the shaft of the low pressure spool. The various rotating components of the engine are supported by oil-lubricated bearings in association with sump seals of a labyrinth or similar construction to prevent oil leakage past the bearings into the main engine gas flow path.

The compressor stage of the high pressure spool comprises a centrifugal impeller mounted within an impeller shroud. This impeller shroud defines a bleed slot or port at a location spaced aft or downstream from the leading edge of the centrifugal impeller. The bleed port has a size and shape for bleed passage of a portion of the compressed air flow through the impeller shroud to a buffer chamber formed within an engine housing. From the buffer chamber, the bleed air is ducted to association with oil sump seals located throughout the engine to provide a pneumatic pressure buffer which prevents oil leakage past those sump seals.

In the preferred form, the bleed port comprises an annular pattern of small ports or holes located in spaced relation from the leading edge of the impeller shroud, by a distance up to about twenty percent of the length of the flow path through the centrifugal compressor. Bleed air approximating one percent of the total compressor flow, when taken through this bleed port, has been found to exhibit sufficient pressure at low engine power and transient power conditions to positively prevent sump seal leakage. At relatively high engine power conditions, however, the pressure of bleed air taken through said bleed port is at a sufficiently low level to prevent overpressurization of the engine sump seals.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
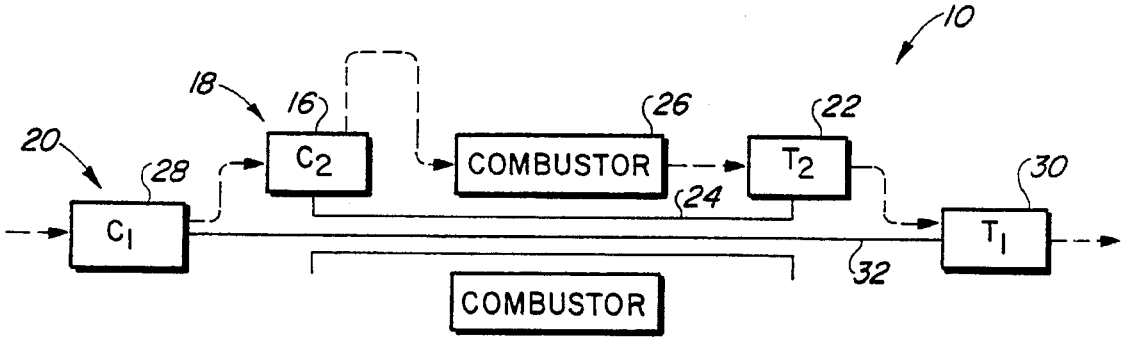
FIG. 1 is a schematic diagram of a typical multiple spool gas turbine engine.

As shown in the exemplary drawings, a gas turbine engine referred to generally by the reference numeral 10 includes an improved bleed air buffer seal arrangement for improved buffer sealing of oil sump seals located throughout the engine. The buffer seal arrangement includes a bleed port 12 (FIG. 2) located along the impeller shroud 14 of a second or high pressure compressor stage 16 of the gas turbine engine 10. Bleed air from this location exhibits sufficient pressure at low engine and transient engine power conditions to provide improved buffer sealing of the sump seals.

FIG. 1 schematically depicts a typical multispool configuration for a gas turbine engine of a type adapted for beneficial use of the improved buffer seal arrangement of the present invention. As shown, the engine 10 comprises a high pressure spool 18 and a low pressure spool 20. The high pressure spool 18 comprises the compressor stage 16 and a related turbine stage 22 mounted at opposite ends of a hollow rotatable shaft 24, with an engine combustor 26 disposed therebetween. The low pressure spool 20 also includes a compressor stage 28 and a related turbine stage 30 mounted at the opposite ends of a rotatable shaft 32, wherein the shaft 32 of the low pressure spool 20 passes through and is rotatably supported within the shaft 24 of the high pressure spool 18.

In operation, the compressor stages 28 and 16 of the separate spools provide dual stage series-flow compression of air which is drawn in by the engine 10 for supply to the combustor 26. The compressed air is burned within the combustor with a suitable fuel (not shown) to generate a high energy mass flow of hot exhaust gases for series-flow expansion through the dual turbine stages 22 and 30. Multiple spool gas turbine engines of this general type are used in a wide range of different applications wherein transient speed conditions and power loads are encountered.

Figure 2:
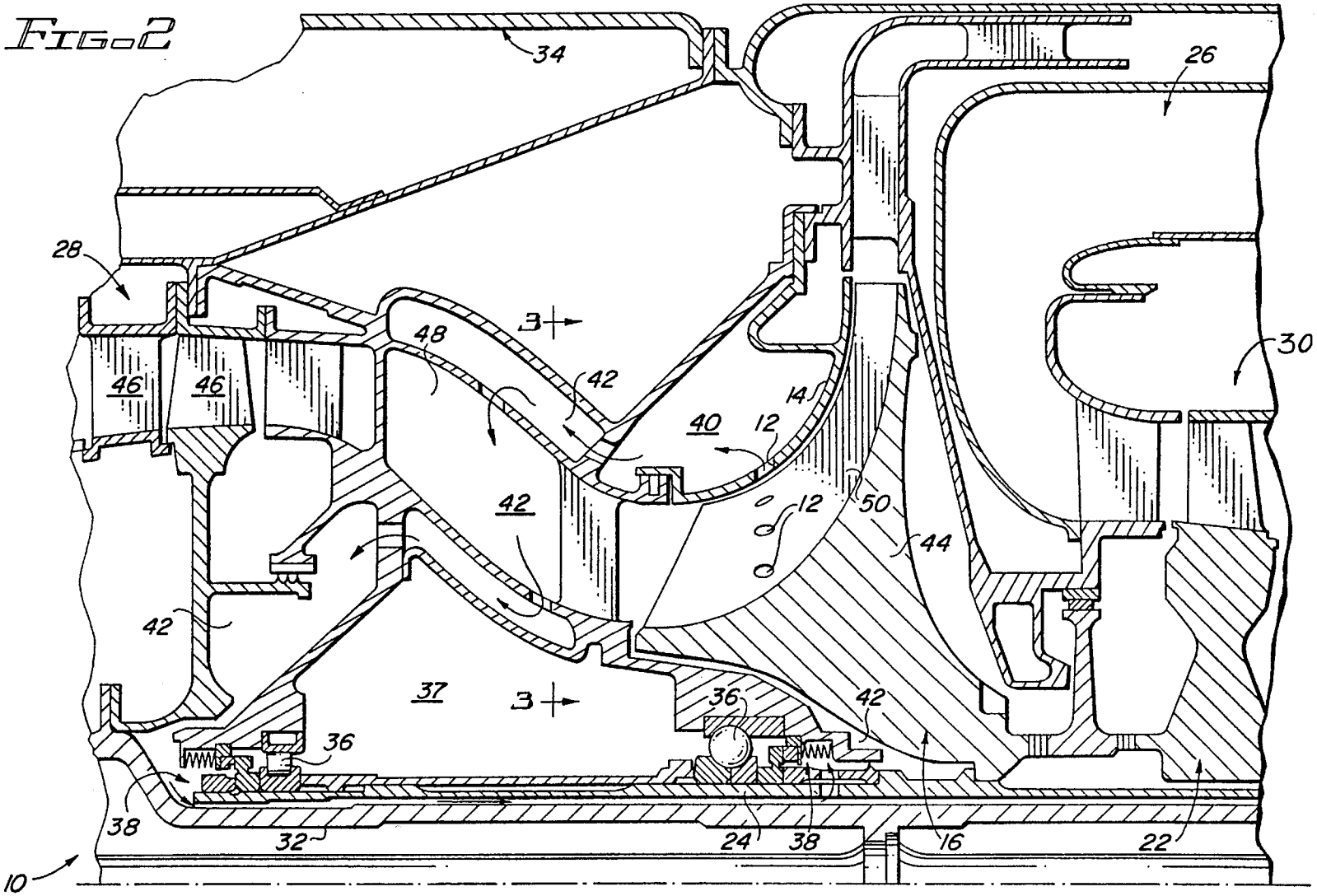
FIG. 2 is an enlarged longitudinal half section of a portion of a multiple spool gas turbine engine, including the improved bleed air buffer seal arrangement in accordance with the present invention.

As shown in FIG. 2, the various rotating components of the gas turbine engine 10 are mounted within an appropriate housing 34 and rotatably supported by appropriate bearings 36. As is known in the art, the bearings 36 located throughout the engine are normally supplied with an appropriate lubricating oil circulated through internal oil flow passages 37. In this regard, substantial oil flow rates and related circulation pressures are common in modern gas turbine engines in order to provide sufficient lubrication to enable engine operation at relatively high speeds and under relatively high temperature conditions.

The various bearings 36 within the engine housing 34 are associated with sump seals 38 shown in FIG. 2. These sump seals 38 are located at one side of selected bearings 36 to provide a barrier between the wet or lubricated oil sump 37 and the dry main gas flow path of the engine. These sump seals 38 may be provided in different forms, such as one or more seal rings disposed at an outboard side of a bearing unit to prevent oil leakage from the lubricated bearing into the main gas flow path of the engine. Other sump configurations include a series of axially spaced seal rings or edges disposed in close running clearance with adjacent surfaces on the stationary engine housing 34 to prevent oil leakage past the associated bearing 36 into the main gas flow path of the engine.

Figure 3:
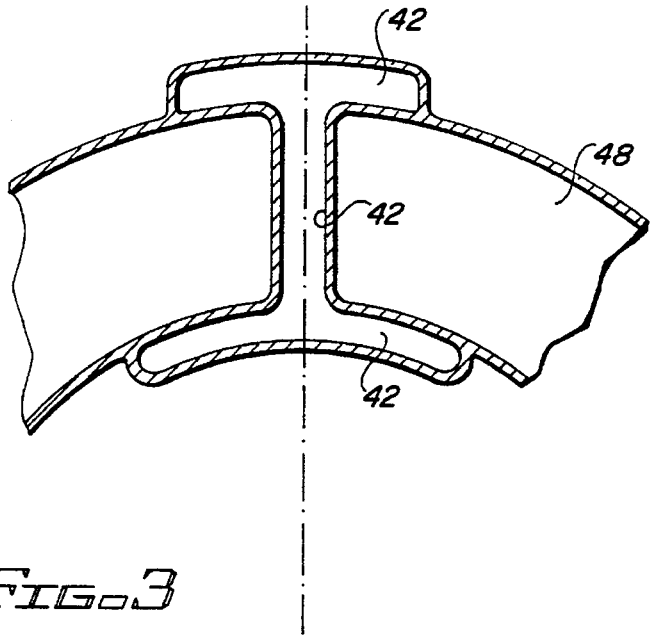
FIG. 3 is an enlarged sectional view taken generally on the line 3—3 of FIG. 2.

In accordance with the present invention, bleed air is taken from the main engine flow path and utilized to provide a pneumatic pressure buffer seal to prevent oil leakage past the sump seals 38. In this regard, the housing 34 of the gas turbine engine is constructed to define an annular plenum or buffer chamber 40 disposed generally about the compressor stage 16 of the high pressure spool 18 to receive bleed air in the form of partially compressed air passing through the two compressor stages 28 and 16. From the buffer chamber 40, suitable duct passage referenced by numeral 42 in FIGS. 2 and 3 are provided to communicate the bleed air to an outboard side of each sump seal 38, namely, the side opposite to the oil flow passage 37, to provide the desired buffer seal. This bleed air has a pressure that is slightly higher than the pressure within the oil flow or sump passages 37 to thereby resist and prevent oil leakage. In typical operation, the pressure of the bleed air should be about 2 psi greater than the sump passage pressure.

In the present invention, the bleed air source is selected to provide the desired pressure characteristics which result in significantly improved buffer sealing of the engine sump seals 38. More particularly, as shown in FIG. 2, the compressor stage 16 of the high pressure spool 18 includes a centrifugal impeller 44 mounted on the shaft 24 within the appropriately contoured impeller shroud 14. Air from the low pressure compressor stage 28, shown in the form of axial-type compressor wheels 46, is discharged to an annular crossover duct 48 for entry into the axially open leading end of the high compressor stage 16. This air is further compressed as it is swept circumferentially and radially along a flow path 50, the length of which is defined by the shape of the impeller wheel 44 and the related impeller shroud 14. The compressed air is discharged from the high pressure stage 16 in a radial direction for subsequent supply to the combustor 26.

The bleed port 12 is formed in the impeller shroud 14 of the high pressure compressor stage at a location disposed aft or downstream of the leading end of the shroud 14. FIG. 2 shows the bleed port 12 in the form of a circumferentially spaced array of small ports or holes, although it will be understood that an annular slot may be used. In either case, the bleed port 12 is located at a position spaced from the aft or upstream end of the impeller shroud 14, by a distance on the order of up to 20 percent of the length of the flow path 50. The open area defined in the bleed port 12 is selected to permit passage of a small portion (about 1 to 2 percent) of the total compressor mass flow from the flow path 50 to the buffer chamber 40. From this buffer chamber 40, the bleed air is communicated to the appropriate outboard side of the various sump seals 38, as previously described.

The location of the bleed port 12 along the shroud 14 of the high pressure compressor stage 16 beneficially yields bleed air at a pressure level which is high enough to provide effective and satisfactory buffer sealing throughout a full range of normal engine operating conditions. That is, the air flowing through the high pressure stage 16 is partially compressed upon reaching the bleed port 12, whereby the bleed air has a pressure level that is somewhat higher than the pressure of air within the crossover duct 48. Such partial additional compression can be particularly important when the engine is operated at low power conditions such as an idle condition., wherein the air pressure within the crossover duct 48 upstream from the high pressure stage 16 can be inadequate to provide satisfactory buffer sealing. Similarly, during a rapid transient condition such as rapid engine acceleration, bleed air pressure at the bleed port 12 is also sufficient to provide satisfactory buffer sealing, whereas the rapid acceleration capability of the high pressure compressor stage 16 can otherwise result in inadequate pressure within the crossover duct 48. At high pressure engine operating conditions, however, the incidence angle of the velocity vector of air entering the high pressure stage 16 is somewhat reduced, such that relatively minimal compression occurs between the leading edge of the compressor stage 16 and the bleed port 12. Thus, at high power conditions, the pressure of the bleed air does not exceed normal design limits for the buffer seals.

Accordingly, the improved buffer seal arrangement of the present invention provides for improved air buffer sealing of the engine sump seals throughout a broader range of normal engine operating conditions, to positively prevent undesired oil leakage past said sump seals and into the main gas flow path of the engine.

A variety of modifications and improvements to the invention described herein will be apparent to those skilled in the art. Accordingly, no limitation on the invention is intended by way of the foregoing description and accompanying drawings, except as set forth in the appended claims.

What is claimed is:

1. In a gas turbine engine having a main gas flow path and separately spooled first and second compressor stages for series compression of air flowing through said main gas flow path, bearing means for rotatably supporting rotating components of the engine, sump means including oil flow passages for circulating lubricant to said bearing means, and sump seals for preventing lubricant leakage from said oil flow passages, a bleed air buffer seal arrangement comprising:

housing means defining a buffer chamber in flow communication with said main gas flow path via a bleed port formed at a location spaced aft from an upstream end of said second compressor stage to provide said buffer chamber with a supply of bleed air which has been compressed by said first compressor stage and partially compressed by said second compressor stage; and said housing means further defining duct means for communicating said bleed air from said buffer chamber to one side of each of said sump seals whereby said bleed air provides a pneumatic buffer to prevent lubricant leakage past said sump seals; and wherein said second compressor stage comprises a centrifugal compressor having a centrifugal impeller rotatably supported within an impeller shroud, said bleed port being formed in said impeller shroud.

2. The gas turbine engine of claim 1 wherein said impeller shroud defines a flow path through said second compressor stage, said bleed port being formed in said impeller shroud at a location spaced from an upstream end of said compressor stage flow path by a distance up to twenty percent of the length of said compressor stage flow path.

3. The gas turbine engine of claim 1 wherein said buffer chamber has a generally annular shape formed about said second compressor stage.

4. The gas turbine engine of claim 2 wherein said bleed port has a size to divert about one percent of the flow through said main gas flow path to said buffer chamber.

5. In a gas turbine engine having a main gas flow path and separately spooled first and second compressor stages for series compression of air flowing through said main gas flow path, bearing means for rotatably supporting rotating components of the engine sump means including oil flow passages for circulating lubricant to said bearing means, and sump seals for preventing lubricant leakage from said oil flow passages, a method of bleed air buffer sealing said sump seals, said method comprising the steps of:

diverting a supply of bleed air from the main gas flow path into a buffer chamber by bleeding air from the second compressor stage at a location spaced aft from an upstream end of the second compressor stage, whereby the bleed air has been compressed by the first compressor stage and partially compressed by the second compressor stage; and communicating the bleed air from the buffer chamber through duct means to one side of each of the sump seals whereby said bleed air provides a pneumatic buffer to prevent lubricant leakage past said sump seals wherein the second compressor stage comprises a centrifugal compressor.

6. A gas turbine engine comprising:

a combustor;

a high pressure spool having a high pressure compressor stage and a high pressure turbine stage mounted at opposite ends of a first rotatable shaft and disposed with said combustor positioned therebetween;

a low pressure spool having a low pressure compressor stage and a low pressure turbine stage mounted at opposite ends of a second rotatable shaft and disposed respectively at opposite ends of said high pressure spool;

housing means cooperating with said combustor and with said high and low pressure spools to define a main gas flow path through the engine whereby said low and high compressor stages provide two-stage series compression of air flowing through said main gas flow path to said combustor, and whereby said high and low pressure turbine stages provide two-stage expansion of gases flowing from said combustor through said main gas flow path;

bearing means for rotatably supporting said first and second rotatable shafts; and sump means including oil flow passages for circulating lubricant to said bearing means, said sump means further including sump seals for preventing lubricant leakage from said oil flow passages;

said housing means further defining a buffer chamber in flow communication with the main gas flow path via a bleed port formed at a location spaced aft from an upstream end of said high pressure compressor stage to provide said buffer chamber with a supply of bleed air which has been compressed by said low pressure compressor stage and partially compressed by said high pressure compressor stage, and duct means for communicating said bleed air from said buffer chamber to one side of each of said sump seals whereby the bleed air provides a pneumatic buffer to prevent lubricant leakage past said sump seals wherein said high pressure compressor stage comprises a centrifugal compressor having a centrifugal impeller rotatably supported within an impeller shroud, said bleed port being formed in said impeller shroud.

7. The gas turbine engine of claim 6 wherein said impeller shroud defines a flow path through said high pressure compressor stage, said bleed port being formed in said impeller shroud at a location spaced from an upstream end of said compressor stage flow path by a distance up to twenty percent of the length of said compressor stage flow path.

8. The gas turbine engine of claim 6 wherein said buffer chamber has a generally annular shape formed about said high pressure compressor stage.

9. The gas turbine engine of claim 6 wherein said bleed port has a size to divert about one percent of the flow through said main gas flow path to said sump buffer chamber.

* * * * *